US010538926B2

(12) United States Patent
Hansort

(10) Patent No.: US 10,538,926 B2
(45) Date of Patent: Jan. 21, 2020

(54) LIFTING ANCHOR ASSEMBLY FOR PRECAST CONCRETE STRUCTURES

(71) Applicant: Midwest Concrete & Masonry Supply, Inc., Naperville, IL (US)

(72) Inventor: Marinus Hansort, St. Pete Beach, FL (US)

(73) Assignee: Midwest Concrete & Masonry Supply, Inc., Naperville, IL (US)

( * ) Notice: Subject to any disclaimer, the term of this patent is extended or adjusted under 35 U.S.C. 154(b) by 0 days.

(21) Appl. No.: 16/110,052

(22) Filed: Aug. 23, 2018

(65) Prior Publication Data

US 2019/0063088 A1 Feb. 28, 2019

Related U.S. Application Data

(60) Provisional application No. 62/549,181, filed on Aug. 23, 2017.

(51) Int. Cl.
*E04G 21/14* (2006.01)
*E04G 15/04* (2006.01)

(52) U.S. Cl.
CPC ..... *E04G 21/142* (2013.01); *E04G 15/04* (2013.01)

(58) Field of Classification Search
CPC ..... E04G 21/142; E04G 15/04
See application file for complete search history.

(56) References Cited

U.S. PATENT DOCUMENTS

| | | | | |
|---|---|---|---|---|
| 4,000,591 | A | 1/1977 | Courtois | |
| 4,367,892 | A | 1/1983 | Holt | |
| 4,437,642 | A * | 3/1984 | Holt | B66C 1/66 249/175 |
| 4,580,378 | A | 4/1986 | Kelly et al. | |
| 4,930,269 | A * | 6/1990 | Kelly | B66C 1/666 294/82.35 |
| 5,014,473 | A * | 5/1991 | Kelly | B66C 1/666 294/82.35 |
| 5,094,047 | A * | 3/1992 | Kelly | E04G 21/142 52/125.5 |
| 5,212,920 | A * | 5/1993 | Tye | E04G 21/142 52/127.1 |
| 5,226,265 | A * | 7/1993 | Kelly | E04G 21/142 294/82.35 |
| 5,588,263 | A | 12/1996 | Kelly et al. | |
| 6,279,274 | B1 | 8/2001 | Amiet et al. | |
| 6,341,452 | B1 | 1/2002 | Bollinghaus | |
| 6,769,663 | B2 * | 8/2004 | Kelly | B28B 23/0056 249/170 |

(Continued)

*Primary Examiner* — Joshua K Ihezie
(74) *Attorney, Agent, or Firm* — Honigman LLP

(57) ABSTRACT

A lifting anchor assembly that is configured to be embedded in a tilt-up concrete structure includes an anchor member that has a central portion configured to engage a lift apparatus and a pair of legs that extend downward from the central portion. A lower portion of each of the pair of legs includes a curved section configured to engage within a concrete structure during its forming process. A spacer may be selected to attach at an end portion of each the pair of legs, where the spacers each extend downward from the anchor member and rest on a floor surface of a concrete form to support the anchor member at a desired spacing from the floor and upright within the concrete structure that is cast in the concrete form.

20 Claims, 8 Drawing Sheets

(56) References Cited

U.S. PATENT DOCUMENTS

| | | | | |
|---|---|---|---|---|
| D559,499 | S | 1/2008 | Scott et al. | |
| D569,071 | S | 5/2008 | Scott et al. | |
| 7,950,190 | B2 * | 5/2011 | Schulze | B28B 23/005 52/125.2 |
| 8,413,400 | B2 * | 4/2013 | Mackay Sim | B28B 7/002 52/576 |
| 8,800,220 | B1 * | 8/2014 | Francies, III | E04G 21/142 249/91 |
| 9,371,650 | B2 * | 6/2016 | Linares, III | E04C 2/288 |
| 10,060,145 | B2 | 8/2018 | Hansort | |
| 2002/0134905 | A1 * | 9/2002 | Domizio | E04G 15/04 249/91 |
| 2006/0248811 | A1 * | 11/2006 | Hansort | E04G 15/04 52/122.1 |
| 2010/0037536 | A1 * | 2/2010 | Schulze | B28B 23/005 52/125.4 |
| 2017/0247232 | A1 | 8/2017 | Hansort | |
| 2018/0187436 | A1 * | 7/2018 | Mackay Sim | E04G 21/142 |

* cited by examiner

LIFTING ANCHOR ASSEMBLY FOR PRECAST CONCRETE STRUCTURES

CROSS-REFERENCE TO RELATED APPLICATION

This application claims benefit and priority under 35 U.S.C. § 119(e) of U.S. provisional application Ser. No. 62/549,181, filed Aug. 23, 2017, which is hereby incorporated herein by reference in its entirety.

TECHNICAL FIELD

The present disclosure generally relates to lifting anchors for tilt-up concrete structures, and more particularly to lifting anchors and assemblies for concrete walls, panels, and the like.

BACKGROUND

Tilt-up precast concrete structures are often used in building constructions, and lifting anchors are commonly embedded or cast in the precast concrete structures to facilitate handling, since these structures can be difficult to hoist and handle due to their weight, bulkiness, and susceptibility to damage, such as cracking, chipping, and other breakage.

SUMMARY

The present disclosure provides a lifting anchor assembly that is adapted to be embedded in tilt-up, precast concrete structures to provide an anchor or attachment point for a lift apparatus, such as a chain or cable or other device that is used to raise and support a concrete structure when positioning or otherwise moving the concrete structure. The lifting anchor assembly includes a clevis or anchor member that has a head or central portion configured to engage the lift apparatus and legs that extend downward from the central portion, such as to form an inverted U or V shape. Thus, the upper portions of the legs may be generally disposed in a common plane. A lower portion of each leg may include a curved section that is configured to engage within the concrete structure. Shoes or spacers may be disposed at base end portions of the legs, such as near the curved sections, where the spacers may include a protrusion or arm that extends downward from the anchor member to rest on a lower surface of a concrete form for supporting the anchor member upright within the concrete structure cast in the concrete form.

According to one aspect of the present disclosure, a lifting anchor assembly includes an anchor member that has a central portion that is configured to engage a lift apparatus and a pair of legs that extend from the central portion. A lower portion of each of the pair of legs includes a curved section that is configured to dispose an end portion of each of the pair of legs in general horizontal alignment with a floor surface of a concrete form. A pair of spacers each have a sleeve portion that is removably engaged at the end portion of one of the pair of legs. The spacers each include at least two protrusions that extends downward from the anchor member and are configured to rest on the floor surface of the concrete form to support the anchor member upright within the concrete form when forming a tilt-up concrete structure in the concrete form.

According to another aspect of the present disclosure, a lifting anchor assembly configured to be embedded in a tilt-up concrete structure includes an anchor member that has a central portion configured to engage a lift apparatus and a pair of legs that extend downward from the central portion. Upper portions of the pair of legs are disposed in a common plane, whereas lower portions of the pair of legs include a curved section that dispose an end portion of each of the pair of legs in generally parallel alignment to the end portion of the other leg and generally perpendicular orientation to the common plane. The curved sections and end portions of the pair of legs are configured to secure the anchor member in the cast tilt-up concrete structure.

According to yet another aspect of the present disclosure, a method of forming a lifting anchor assembly that is configured to be embedded in a concrete structure includes providing an elongated section of metal bar stock. The elongated section is bent to form an anchor member having a central portion for engaging a lift apparatus and a pair of legs that extend downward from the central portion in a generally common plane. A lower portion of each leg of the pair of legs includes a curved section that is configured to engage within a cast concrete structure. An end portion of each leg of the pair of legs extends orthogonally out of the common plane, such that the curved sections and end portions are configured to secure the anchor member in the cast concrete structure.

These and other objects, advantages, purposes, and features will become apparent upon review of the following specification in conjunction with the drawings.

DETAILED DESCRIPTION

Figure 1:
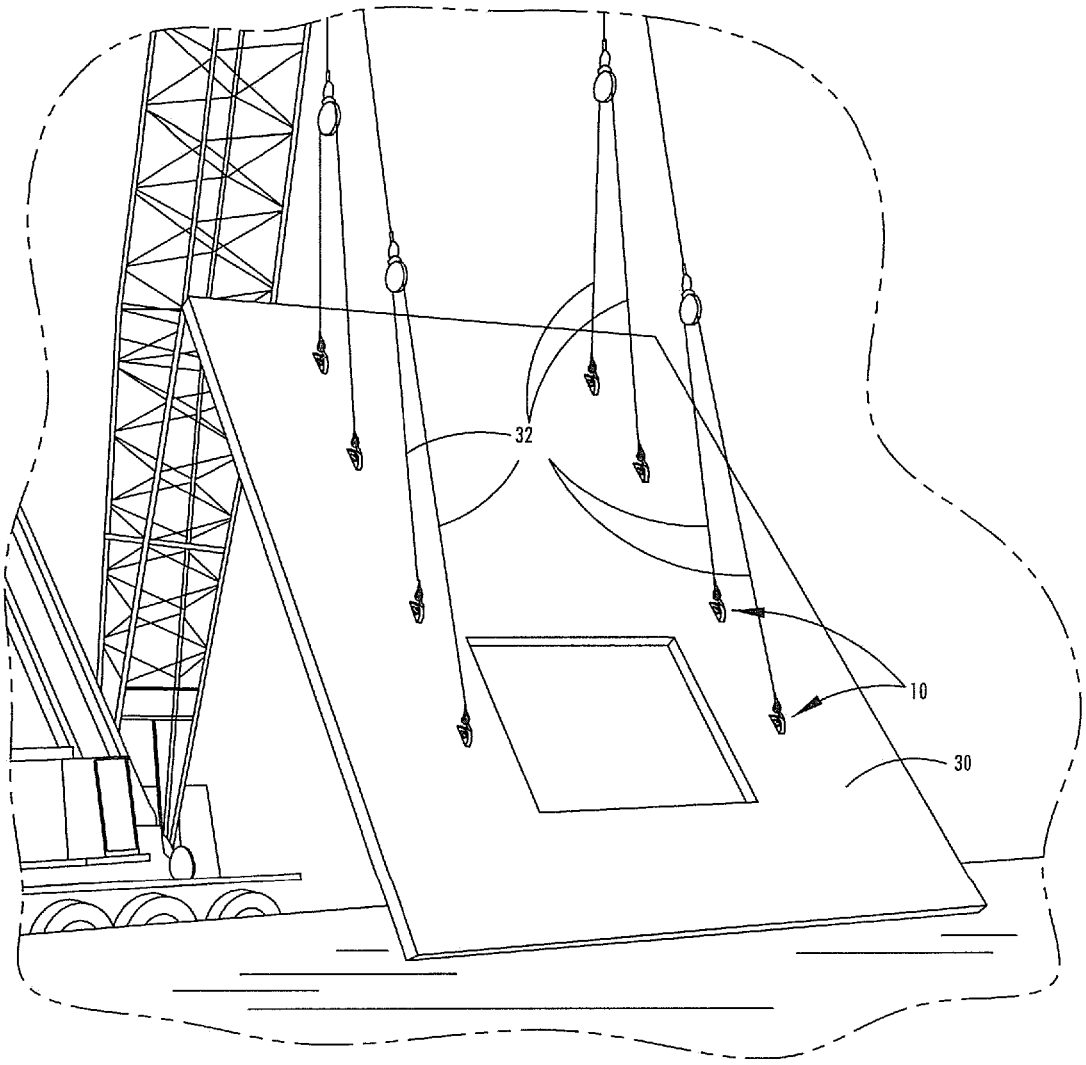
FIG. 1 is a perspective view of a tilt-up, precast concrete structure that is lifted by attaching lift cables to several lifting anchor assemblies.
Figure 2:
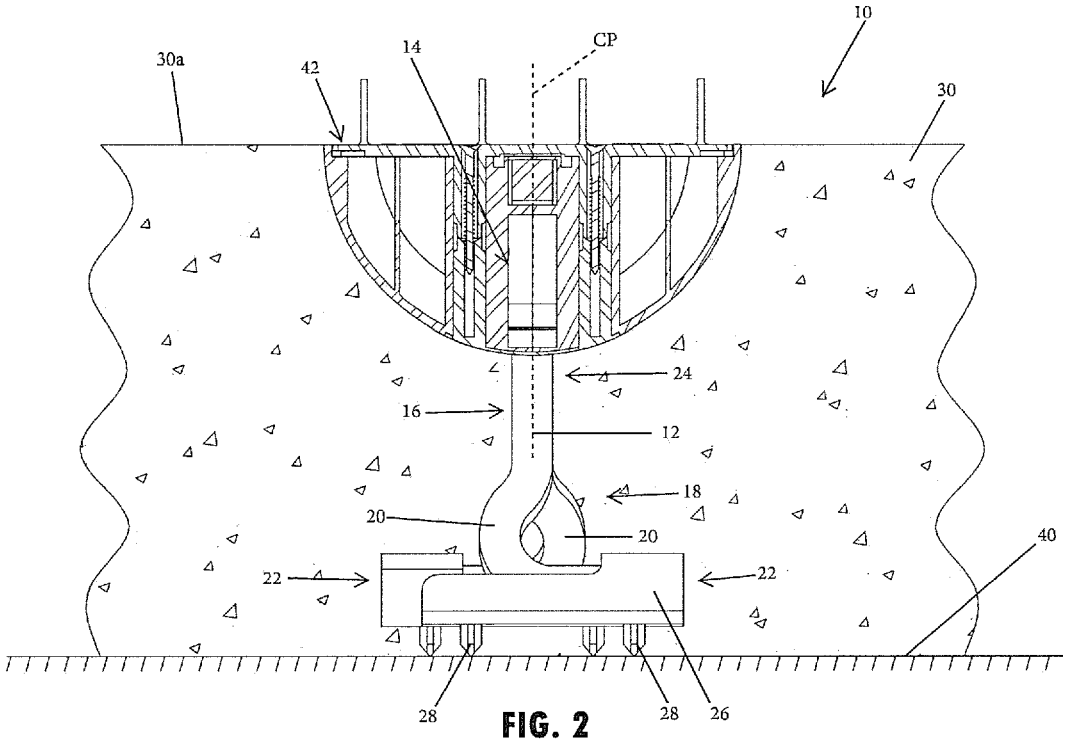
FIG. 2 is a cross-sectional view of a precast concrete structure and a lifting anchor assembly prior to removal of a void former.
Figure 2A:
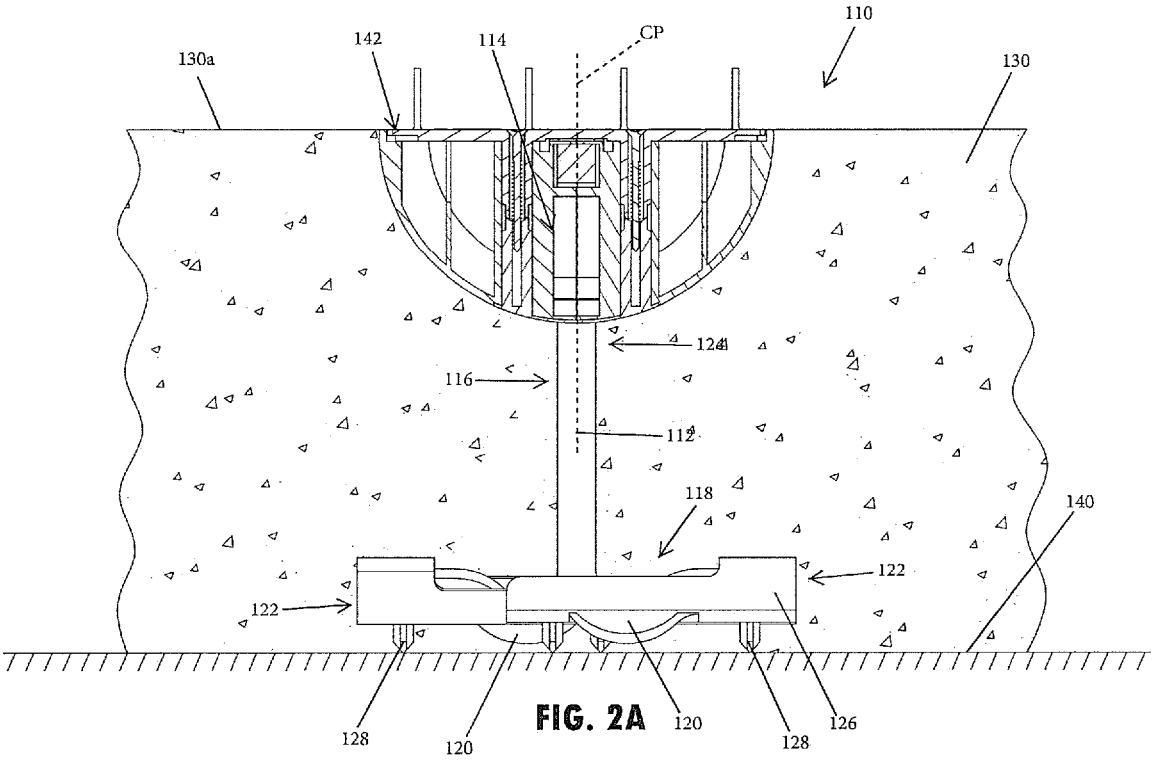
FIG. 2A is a cross-sectional view of a precast concrete structure and an additional embodiment of a lifting anchor assembly.
Figure 3:
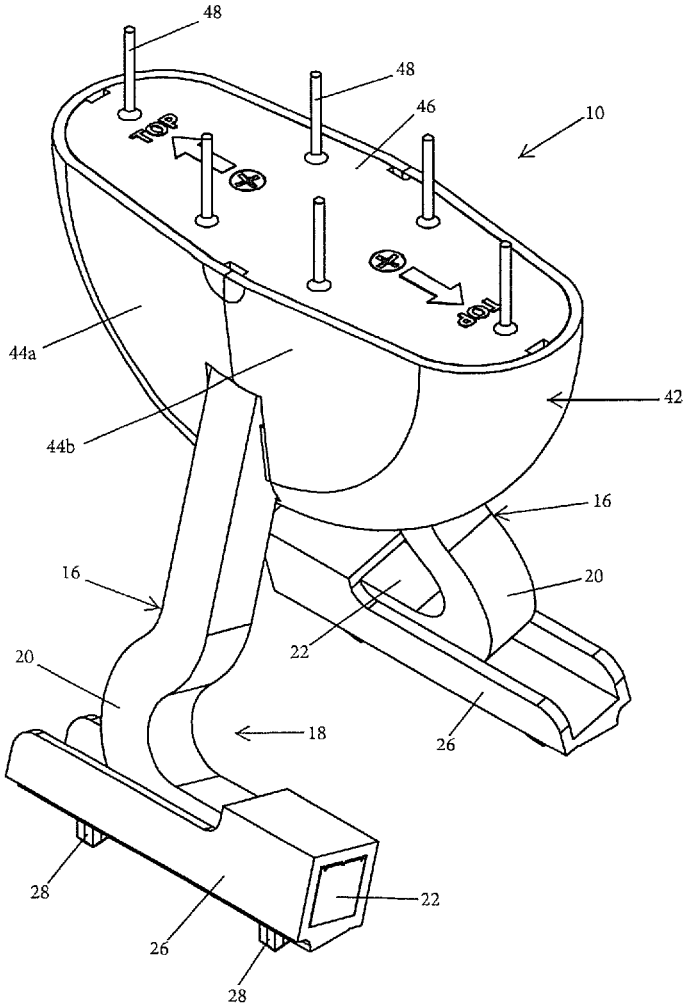
FIG. 3 is an upper perspective view of the lifting anchor assembly of FIG. 2.
Figure 4:
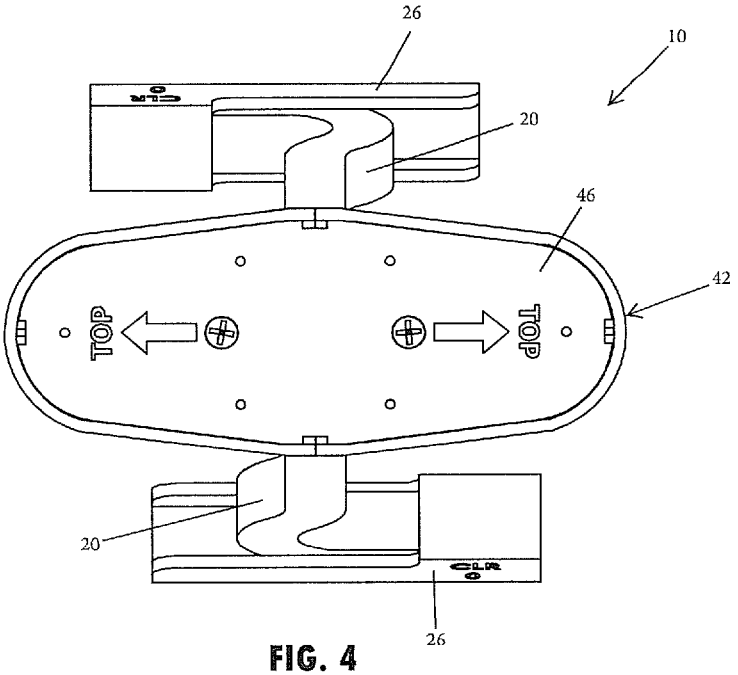
FIG. 4 is an upper plan view of the lifting anchor assembly of FIG. 2.
Figure 5:
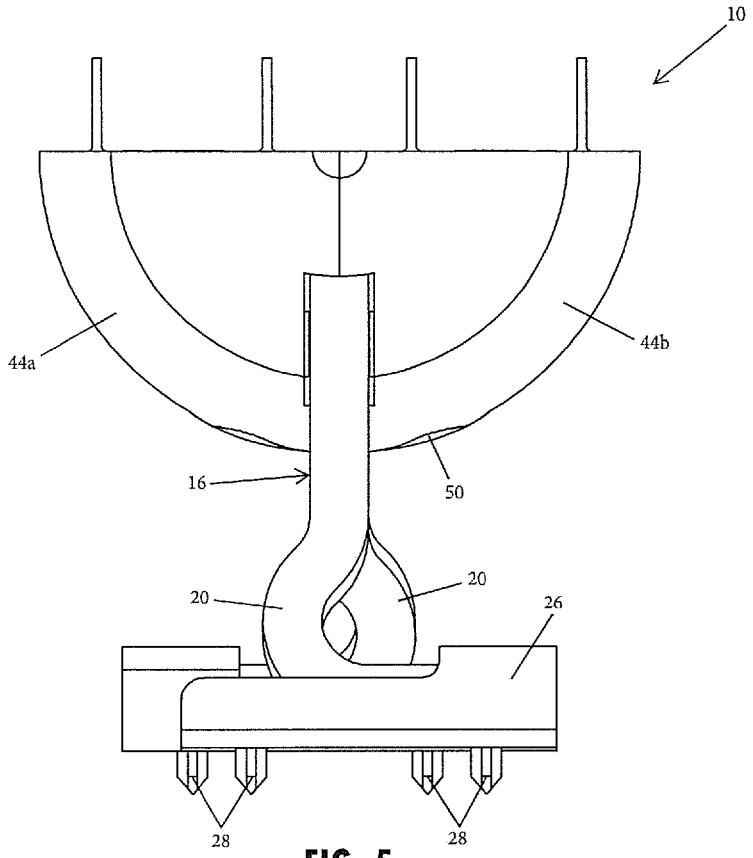
FIG. 5 is a side elevational view of the lifting anchor assembly of FIG. 2.
Figure 6:
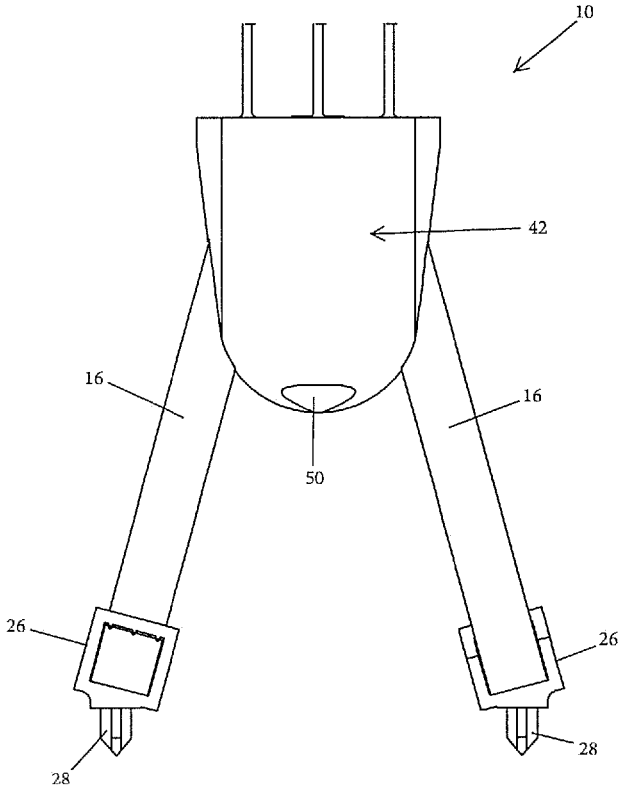
FIG. 6 is an end elevational view of the lifting anchor assembly of FIG. 2.

Referring now to the drawings and the illustrative embodiments depicted therein, a lifting anchor assembly 10, 110 such as shown in the examples illustrated in FIGS. 1-2A, is embedded in a tilt-up, precast concrete structure 30, 130 to provide a balanced and secure anchor or attachment point for a lift apparatus 32, such as a chain or cable that may be attached via a lifting clutch or hook or the like. Such an anchor or attachment point provided by the lifting anchor assembly may be used to raise and support the concrete structure 30, 130 when positioning or otherwise moving the concrete structure 30, 130 (FIG. 1).

Figure 7:
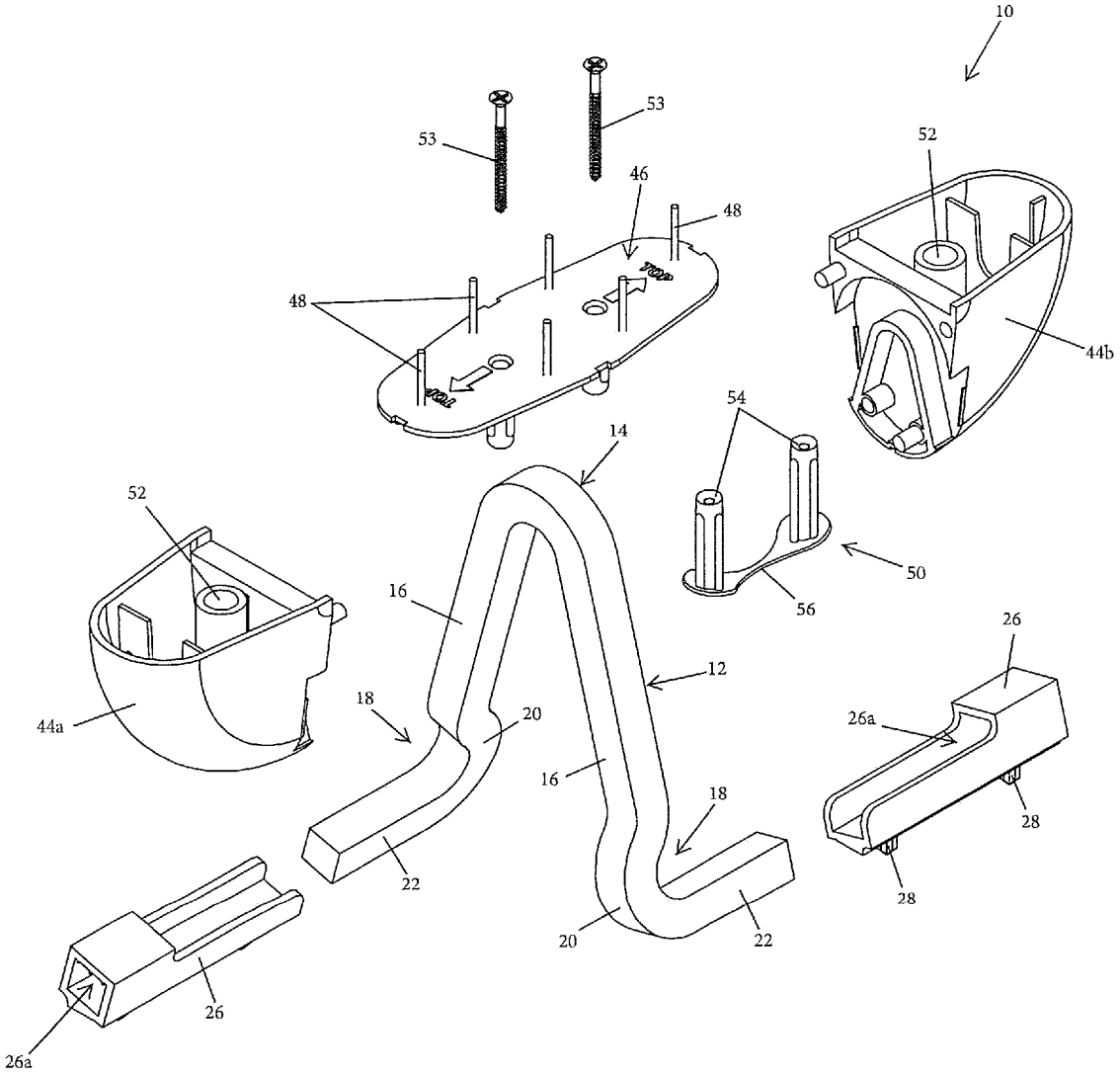
FIG. 7 is an exploded upper perspective view of the lifting anchor assembly of FIG. 2.
Figure 8:
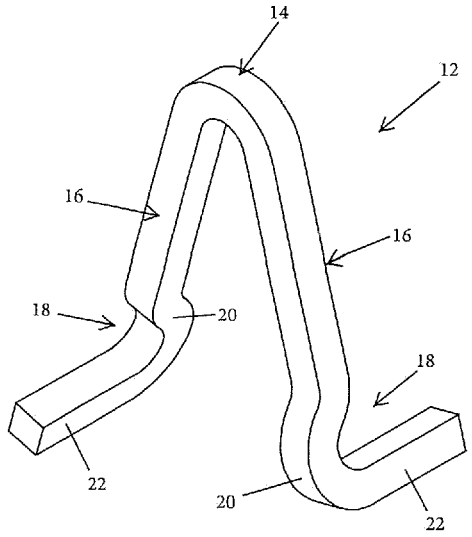
FIG. 8 is an upper perspective view of an anchor member of the lifting anchor assembly shown in FIG. 7.
Figure 9:
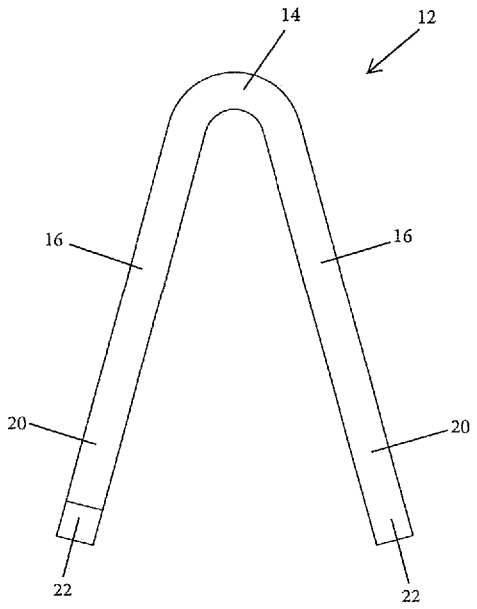
FIG. 9 is an end elevational view of the anchor member of FIG. 8.
Figure 10:
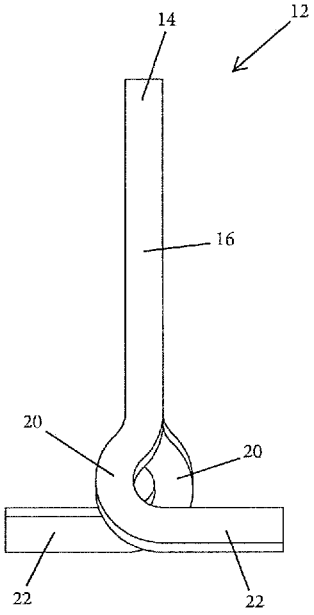
FIG. 10 is a side elevational view of the anchor member of FIG. 8.
Figure 11:
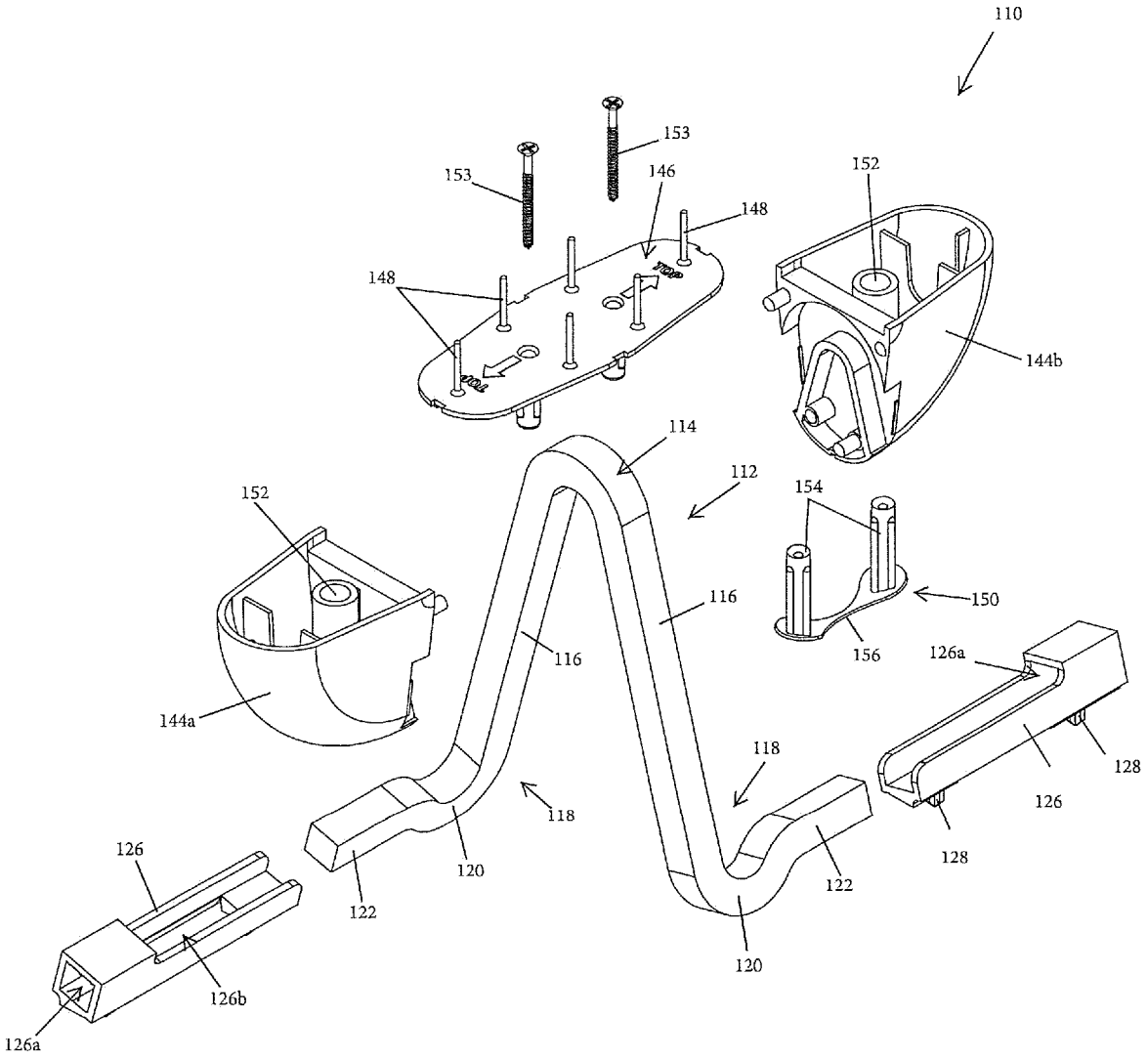
FIG. 11 is an exploded upper perspective view of the lifting anchor assembly of FIG. 2A.
Figure 12:
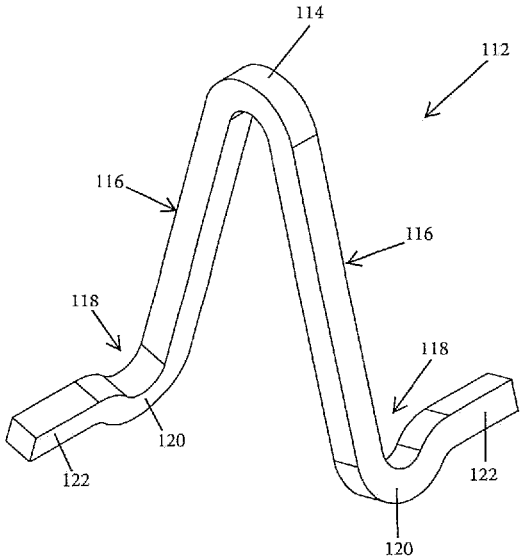
FIG. 12 is an upper perspective view of an anchor member of the lifting anchor assembly shown in FIG. 11.
Figure 13:
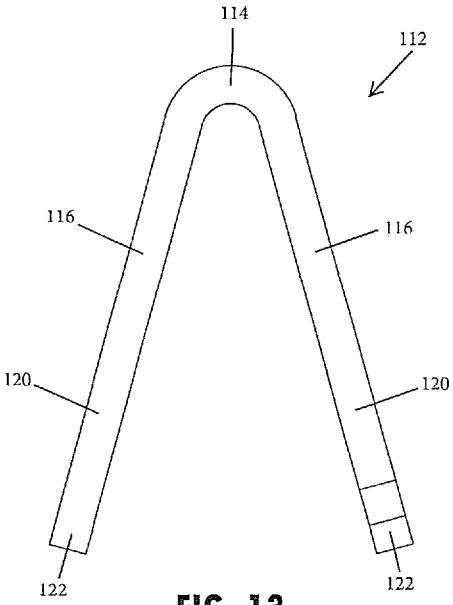
FIG. 13 is an end elevational view of the anchor member of FIG. 11.
Figure 14:
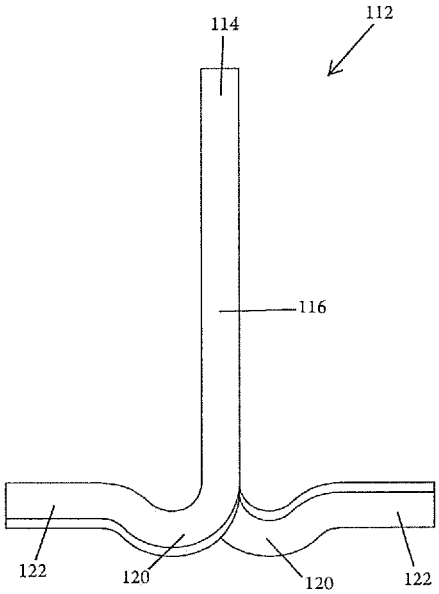
FIG. 14 is a side elevational view of the anchor member of FIG. 11.

The anchor member 12, 112 provides the structural reinforcement and support to lift the concrete structure 30, 130 for the lifting anchor assembly 10, 110 that is embedded in the concrete structure. Thus, the anchor member 12, 112 may be made of a sufficiently strong and rigid material, such as a metal, for example a steel or aluminum alloy or the like, and may be shaped to provide an accessible loop or attachment point that, when embedded in the concrete structure 30, 130, is resistive to being withdrawn by lifting from the exposed loop or attachment point. As shown in the illustrated embodiments, the attachment point configured to engage a lift apparatus 32 is provided at a head or central portion 14, 114 of the anchor member 12, 112 with the legs 16, 116 extending downward from the central portion, such as to form an inverted U or V shape (FIGS. 7 and 11). Prior to curing or hardening of the cement structure, the central portion 14, 114 may be engaged by a void former 42, 142 that is subsequently removed to allow for accessibility of the central portion 14, 114. The legs 16, 116 of the anchor member 12, 112 that extend downward from the central portion 14, 114 may be provided with a retention feature to assist with preventing withdrawal of the anchor member 12, 112 from the concrete structure 30, 130, such as during use with a lifting apparatus so as to increase the lifting load capacity of the anchor member.

The lifting anchor assembly 10, as illustrated in FIGS. 2 and 3-10, has a retention feature disposed at a lower portion 18 of each leg 16 that is configured to engage within the concrete structure 30 during its forming process. The retention feature, as shown in FIG. 2, includes a curved section 20 that is integrally formed along the length of the respective leg by providing a bend in the bar stock of the leg. The curved section 20 may have an arcuate shape that is configured to engage the concrete structure, such as a horizontally oriented U shape as shown in FIG. 2 or a serpentine configuration or the like. The curved sections 20 are arranged to prevent withdrawal of the anchor member 12 from the concrete structure 30 along the load paths that, as shown, extend linearly along the upper portions 24 of the legs 16. Thus, the curved sections 20 divert the load path outside of the linear extension of the upper portions of the legs 14 to thereby disperse loads applied by the anchor member 12 to a larger area of the cast concrete structure 30. It is contemplated that additional and/or alternative retention features may be provided at the leg in other embodiments, such as by providing a molded protrusion or the like at the lower portion of the leg.

The end portions 22 of the legs 16 may be bent or otherwise formed to extend at an angle away from the upper portions 24, such as in opposing directions from the curved sections 20. As illustrated in FIG. 2, the upper portions 24 of the legs 16 are generally disposed in a common plane CP, such that the end portions 22 of the legs 16 extend in opposing directions out of the common plane CP and generally perpendicular to the common plane CP. By extending out of the common plane CP, the curved sections 20 and end portions 22 are arranged to secure and disperse loads applied by the anchor member 12 in the cast concrete structure 30. Moreover, the end portions 22 of the legs 16 may be angled sufficiently to be generally parallel with each other and may also or alternatively be generally parallel with a lower surface 40 of a concrete form. Further, the curved section 20 may protrude away from the common plane CP, such as shown in FIG. 2, where the curved section 20 on each leg 16 protrudes in one direction out of the common plane CP and, due to the U-shaped curvature of the curved section 20, the corresponding end portion 22 of the leg 16 is then disposed in the opposing direction out of the common plane. It is understood that the end portions of the legs may be disposed at various angles and orientations within the concrete structure in additional embodiments of the anchor assembly.

The central portion 14 and legs 16 of the anchor member 12, as illustrated in FIGS. 7-10, may comprise a single strand or bar stock having a generally square shaped cross section. The single strand of bar stock may be bent in the common plane CP to provide the illustrated shape of the central portion 14 and the upper portion of the legs 16, while the bar is bent out of the common plane CP to form the curved sections 20 and the end portions 22 extending in opposite directions from the common plate. It is contemplated that the anchor member may be alternatively shaped in additional embodiments, such as for use with differently shaped concrete structures from the illustrated concrete panel.

As illustrated in FIG. 2, shoes or spacers 26 may be disposed at the end portions 22 of the legs 16, such as by sliding the spacer 26 over or onto the end portions 22 to attach or engage the spacer 26 with the anchor member 12. The spacers 26 may have a portion, such as at least one protrusion or spacing pin or line 28, that extends downward from the anchor member 12 to rest on the lower surface 40 of a concrete form. By engaging the lower surface 40 of the concrete form, the spacers 26 support the anchor member 12 upright within the concrete structure 30 cast in the concrete form, such as to position the common plane CP defined by the legs 16 in a generally vertical orientation that corresponds with a depth of the cast concrete structure. The spacers 26 may be configured to matably engage with the end portions 22 of the legs 16 and likewise the end portions 22 may similarly be configured to engage with the spacers 20 to prevent movement or rotation there between. As shown in FIGS. 3-7, the end portions 22 of the legs 16 may each include a generally orthogonal cross-sectional shape that engages a similarly shaped aperture 26*a* in the engagement portion of the spacer 26 to prevent the spacers 26 from rotating relative to the anchor member 12. It is contemplated that more or fewer spacers may be attached to the anchor member, such as to accommodate differently shaped or configured anchor members or concrete structures.

As also shown in FIGS. 3-7, the spacers 26 each include an engagement portion that engages the anchor member 12 in the selected orientation. The illustrated engagement portion provides the rectangular aperture 26*a* for slip-attachment onto the end portions 22 of the legs 16, so that the spacing pin 28 extends in a direction (downwardly) away from the U-shaped central portion 14 of the anchor member 12. The engagement portion may have attachment features, such as ribs that protrude radially into the rectangular aperture and that are configured to resiliently compress or elastically deform to provide a tight friction fit when the spacers are slipped on to and into engagement with the ends of the legs. Thus, the spacers may comprise a polymeric material, such as being formed by an injected molded plastic or the like.

Optionally, the spacers 26 may be removable and replaceable to accommodate concrete structures with different thicknesses, such as by attaching a shoe or spacer with a lower or higher pin to provide local adjustability and easily be able to change the height of the total insert or assembly. Optionally, a set of spacers or shoes may be attached with differently sized spacing pins that extend radially at different lengths to provide various heights of the spacer. Thus, the vertical position of the anchor member 12 within a thickness of a concrete structure 30 may be adjusted by selecting a desired spacer 26 that positions the anchor member at a desired vertical position in the concrete structure, such as with the central portion 14 of the anchor member 12 at or near an upper surface 30*a* of the concrete structure 30, as it may be desired for the central portion 14 to be positioned a selected distance from the upper surface 30*a* to expose it adequately for engaging a lift apparatus. As shown in FIG. 2, the anchor thickness may be defined between an uppermost surface of the anchor member, shown at the central portion 14 and a lowermost surface of the spacing pin 28. By selecting a desired spacer, the anchor thickness may be adjusted to be substantially equal to or less than a thickness dimension of the tilt-up concrete structure 30 proximate the embedded lifting anchor assembly 10.

To allow the central portion 14 to be exposed and accessible after forming the concrete structure 30, the lifting anchor assembly 10 may be cast within a thickness of the concrete structure 30 with a cap or void former 42 (FIGS. 3-7) engaged with the anchor member 12 to conceal the upper section of the central portion 14 of the lifting anchor assembly 10. As shown in FIG. 2, the concrete structure 30 is cured or hardened (from wet/fluid concrete with the structure being laid on the ground or lower surface of the concrete form) with the void former attached, and when cured and hardened, the void former 42 may be removed to provide a cavity at the upper surface 30*a* of the concrete structure 30 that exposes the central portion 14 of the anchor member 12.

As shown in FIGS. 3-7, the void former 42 includes a two-piece shell 44 that has a rounded convex exterior surface that forms the cavity at the upper surface 30*a*. The shell 44 is divided into two pieces 44*a*, 44*b* that each provide an outer surface that approximately forms a half or 90 degrees of the cavity. The shell 44 of the void former 42 may have a thin-walled generally-hollow polymeric body formed by the opposing halves 44*a* and 44*b*, where the halves 44*a*, 44*b* mate together and are secured together by a tie component 50 and/or a top plate or cover 46 that engages a top of the shell 44. The tie component 50 may include plug portions 54 to fit within and seal off openings 52 defined in the shell 44, where the plug portions 54 may be engaged by fasteners 53 that extend through the cover 46. The tie component 50 may comprise a flexible material, such as a polymer or rubber or the like, that allows plug portions 54 to be tightly fit within the bottom openings 52 and for a strap portion 56 of the tie component 50 that interconnects the plug portions 54 to flex and stretch.

In addition to securing the shell pieces together, the cover 46 also prevents overspill into the, otherwise exposed interior, of the shell 44 during the concrete pouring stages of the tilt-up, precasting process or when inserting the lifting anchor assembly 10 into a wet bed of concrete. The illustrated cover 46 includes upwardly-extending protruding rods 48 that form handles to facilitate removal of the cover 46 after the wet concrete is sufficiently cured and there is no need for the hollow shell 44 to continue to be covered. The shell halves 44*a*, 44*b* thus form a protected sealed-off area under an engagement portion of the inverted U-shaped center 14. This is done to prevent intrusion of wet concrete, so that the area remains open and can receive a lift apparatus, such as a chain, cable, or hook or the like, that is extended under the central portion to facilitate lifting of the precast concrete structure 30.

Referring now to the lifting anchor assembly 110 illustrated in FIGS. 2A and 11-14, the retention feature includes a curved section 120 that is integrally formed along the length of the respective leg 116 by providing a bend in the bar stock of the leg. The curved section 120 has an arcuate shape that is configured to engage the concrete structure 130, where the arcuate shape is oriented as a U shape that protrudes downward outside of the common plane CP, so as to be positioned below the end portions 122 of the legs 116. Thus, the curved section 120 and the corresponding end portion 122 extend together in the same direction away from the common plane, so that the curved sections 120 and end portions 122 of each leg 116 are disposed on opposing sides of the common plane CP. As illustrated in FIG. 2A, the upper portions 124 of the legs 116 are generally disposed in a common plane CP, such that the end portions 122 of the legs 116 extend in opposing directions out of the common plane CP and generally perpendicular to the common plane CP. Moreover, the end portions 122 of the legs 116 may be angled sufficiently to be generally parallel with each other and may also or alternatively be generally parallel with a lower surface 140 of a concrete form, as shown in FIG. 2A.

As also illustrated in FIG. 2A, shoes or spacers 126 may be disposed at the end portions 122 of the legs 116, such as by sliding the spacer 126 over or onto the end portions 122 to attach or engage the spacer 126 with the anchor member 112. The spacers 126 have two protrusions or spacing pins or lines 128 that extend downward from the anchor member 112 to rest on the lower surface 140 of a concrete form. By engaging the lower surface 140 of the concrete form, the spacers 126 support the anchor member 112 upright within the concrete structure 130 cast in the concrete form, such as to position the common plane CP defined by the legs 116 in a generally vertical orientation that corresponds with a depth of the cast concrete structure. The spacers 126 each include an engagement portion that engages the anchor member 112 in the selected orientation. The engagement portion as shown in FIG. 11 provides a rectangular aperture 126*a* for slip-attachment onto the end portions 122 of the legs 116, and further an additional bottom aperture 126*b* is provided in the spacer 126 to allow the curved section 120 to protrude downward through the spacer 126 toward the floor 140 of the concrete form.

Unless described otherwise, the features of the lifting anchor assembly 110 shown in FIGS. 2A and 11-4 are generally the same as those described above with reference to FIGS. 2 and 3-10, with the referenced numbers increased by 100. It is further contemplated that the lifting anchor assembly may include various alternative shapes and configurations from those described and illustrated herein.

A method related to the above, such as for forming a lifting anchor assembly, includes providing an elongated section of metal bar stock. The method may include bending the elongated section to form an anchor member having a central portion for engaging a lift apparatus and a pair of legs that extend downward from the central portion in a generally common plane. When forming the anchor member, a lower portion of each leg of the pair of legs may be formed or bent to include a curved section that is configured to engage within a cast concrete structure. Also, an end portion of each leg of the pair of legs may be formed or bent to extend out of the common plane CP, such that the curved sections and end portions are configured to secure the anchor member in the cast concrete structure. Further, the method may include sliding or otherwise disposing a spacer over the end portion of each leg of the pair of legs, where the spacers may each include a protrusion that extends downward from the anchor member. The method may further provide detachably engaging the void former around the central portion of the anchor member, such that after the concrete structure is hardened, the void former is removed to provide a cavity at the upper surface of concrete structure that exposes the central portion of the anchor member.

For purposes of this disclosure, the terms "upper," "lower," "right," "left," "rear," "front," "vertical," "horizontal," and derivatives thereof shall relate to the anchor assembly as oriented in FIG. 2. However, it is to be understood that the anchor assembly may assume various alternative orientations, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

The invention claimed is:

1. A lifting anchor assembly comprising:

an anchor member having a central portion configured to engage a lift apparatus and a pair of legs that extend from the central portion;

wherein an upper portion of each leg of the pair of legs extends linearly from the central portion and is disposed in a common plane with the other leg of the pair of legs;

wherein a lower portion of each leg of the pair of legs includes a retention feature that is configured to divert a load path applied by the lift apparatus outside of a linear extent of the upper portion of the respective leg;

wherein an end portion of each leg of the pair of legs extends linearly from the lower portion of the respective leg to dispose the end portion in parallel alignment with the end portion of the other leg and in general alignment with a floor surface of a concrete form;

wherein the retention feature includes an arcuate curved section of the anchor member that extends out of the linear extent of at least one of the upper portion and the end portion of the respective leg;

a pair of spacers each having a sleeve portion removably engaged at the end portion of one leg of the pair of legs; and wherein the pair of spacers each include at least two protrusions that are coupled with and extend downward from the sleeve portion at a length that is configured to rest on the floor surface of the concrete form to support the anchor member upright and suspended within the concrete form when forming a tilt-up concrete structure in the concrete form.

2. The lifting anchor assembly of claim 1, wherein the pair of spacers are each configured to be removable and replaceable with a selected second pair of spacers having protrusions with a second length to provide a different spacing of the anchor member from the floor surface of the concrete form.

3. The lifting anchor assembly of claim 1, wherein the common plane that the upper portion of the pair of legs are disposed is configured to be generally perpendicular to the floor surface of the concrete form.

4. The lifting anchor assembly of claim 1, wherein the end portions of the pair of legs extend out of opposing sides of the common plane of the pair of legs.

5. The lifting anchor assembly of claim 1, wherein the arcuate curved section of the retention feature on each leg of the pair of legs has a U shape that is configured to be engaged within the concrete structure.

6. The lifting anchor assembly of claim 1, wherein the end portion of each leg of the pair of legs is generally parallel to the floor surface of the concrete form.

7. The lifting anchor assembly of claim 1, further comprising a void former configured to detachably engage the central portion of the anchor member, wherein, after the concrete structure is hardened, the void former is configured to be removed to provide a cavity at an upper surface of the concrete structure that exposes the central portion of the anchor member.

8. A lifting anchor assembly configured to be embedded in a tilt-up concrete structure, said lifting anchor assembly comprising:

an anchor member having a central portion configured to engage a lift apparatus and a pair of legs that extend downward from the central portion;

wherein upper portions of the pair of legs are disposed in a common plane;

wherein lower portions of the pair of legs include a retention feature that is configured to divert a load path applied by the lift apparatus outside of a linear extent of the upper portion of the respective leg;

wherein end portions of the pair of legs extend linearly from the lower portion of the respective leg to dispose the end portions in parallel alignment with each other and generally perpendicular orientation to the common plane; and wherein the retention feature includes an arcuate curved section of the anchor member that extends out of a linear extent of at least one of the upper portion and the end portion of the respective leg and is configured to secure the anchor member in the tilt up concrete structure.

9. The lifting anchor assembly of claim 8, wherein the end portion of each of the pair of legs is configured to be generally parallel with a lower surface of a concrete form used for forming the cast concrete structure.

10. The lifting anchor assembly of claim 8, further comprising a removable spacer engaged at the end portion of each of the pair of legs, wherein the removable spacers each include at least one protrusion that extends downward from the anchor member at a length that is configured to rest on a lower surface of a concrete form to support the anchor member upright and suspended within the concrete form when forming the tilt-up concrete structure in the concrete form.

11. The lifting anchor assembly of claim 10, wherein the end portions of the pair of legs each include a generally orthogonal cross-sectional shape configured to prevent the spacers from freely rotating relative to the anchor member.

12. The lifting anchor assembly of claim 10, wherein an anchor thickness is defined between an uppermost surface of the anchor member to a lowermost surface of the protrusion, and wherein the anchor thickness is configured to be substantially equal to or less than a thickness dimension of the tilt-up concrete structure.

13. The lifting anchor assembly of claim 8, wherein the arcuate curved sections of the anchor member are disposed between the upper portions and the end portions of the pair of legs, and wherein the arcuate curved sections include a U shape that is configured to disperse lifting forces applied at the central portion of the anchor member across the cast concrete structure.

14. The lifting anchor assembly of claim 9, wherein the central portion and the legs of the anchor member comprise an inverted V or U shape.

15. A method of forming a lifting anchor assembly configured to be embedded in a concrete structure, said method comprising:

providing an elongated section of metal bar stock;

bending the elongated section to form an anchor member having a central portion for engaging a lift apparatus and a pair of legs that extend downward from the central portion in a generally common plane; and wherein a lower portion of each leg of the pair of legs includes an arcuate curved section that is configured to engage within a cast concrete structure;

wherein an end portion of each leg of the pair of legs extends orthogonally out of the common plane, such that the arcuate curved sections and end portions are configured to secure the anchor member in the cast concrete structure;

selecting a pair of spacers with spacing protrusions having a desired length from a plurality of pairs of spacers with spacing protrusions with different lengths;

engaging the pair of spacers with the end portions of the pair of legs; and wherein the desired length of the selected pair of spacers is configured, when the spacing protrusions are resting on a floor surface of a concrete form, to support the anchor member upright and suspended within the concrete form for the central portion of the anchor member to be at or near an upper surface of the cast concrete structure for engaging the lift apparatus.

16. The method of claim 15, wherein the arcuate curved section is angles the end portion of each leg of the pair of legs in generally parallel alignment with each other and with a lower surface of the concrete form.

17. The method of claim 15, wherein the pair spacers are inserted over the and matably engage with the pair of legs, and wherein the pair of spacers each include at least two spacing protrusions that extend downward from the anchor member.

18. The method of claim 17, wherein the pair of spacers are configured to be selected for the protrusion to have a desired length of the spacing protrusions to provide a desired spacing of the anchor member away from the floor surface of the concrete form.

19. The method of claim 17, wherein the arcuate curved sections include a U shape that is configured to disperse lifting forces applied at the central portion of the anchor member across the cast concrete structure.

20. The method of claim 17, wherein a void former is configured to detachably engage around the central portion of the anchor member, and wherein the void former is configured to be cast into an upper portion of the concrete structure and, after the concrete structure is hardened, removed to provide a cavity at the upper surface of concrete structure that exposes the central portion of the anchor member.

* * * * *